US005439067A

United States Patent [19]

Huffstutler

[11] Patent Number: 5,439,067

[45] Date of Patent: Aug. 8, 1995

[54] ROCK BIT WITH ENHANCED FLUID RETURN AREA

[75] Inventor: Alan D. Huffstutler, Grand Prairie, Tex.

[73] Assignee: Dresser Industries, Inc., Dallas, Tex.

[21] Appl. No.: 287,457

[22] Filed: Aug. 8, 1994

[51] Int. Cl.[6] ..... E21B 10/18; E21B 10/20

[52] U.S. Cl. ..... 175/339; 175/357

[58] Field of Search ..... 175/105, 331, 339, 342, 175/346, 353, 357, 363

[56] References Cited

U.S. PATENT DOCUMENTS

| | | | |
|---|---|---|---|
| Re. 19,339 | 10/1934 | Vertson | 255/73 |
| 1,906,427 | 5/1933 | Sievers et al. . | |
| 1,908,049 | 5/1933 | Reed . | |
| 2,030,723 | 2/1936 | Scott et al. | 255/71 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 255/71 |
| 2,068,375 | 1/1937 | Catland | 175/357 |
| 2,124,521 | 7/1938 | Williams et al. | 255/71 |
| 2,151,347 | 3/1939 | Fisher | 255/71 |
| 2,318,370 | 5/1943 | Burch | 255/71 |
| 2,648,526 | 8/1953 | Lanchester | 255/71 |
| 2,782,005 | 2/1957 | Appleton | 255/340 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte | 219/121 |
| 4,056,153 | 11/1977 | Miglierini | 175/376 |
| 4,067,406 | 1/1978 | Garner et al. | 175/341 |
| 4,280,571 | 7/1981 | Fuller | 175/337 |
| 4,333,364 | 6/1982 | Varel | 76/108 |
| 4,350,060 | 9/1982 | Vezirian | 76/108 |
| 4,352,400 | 10/1982 | Grappendorf et al. | 175/330 |
| 4,369,849 | 1/1983 | Parrish | 175/340 |
| 4,417,629 | 11/1983 | Wallace | 175/356 X |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,630,693 | 12/1986 | Goodfellow | 175/366 |
| 4,711,143 | 12/1987 | Loukanis et al. | 76/108 |
| 4,727,943 | 3/1988 | Wood | 175/229 |
| 4,750,573 | 6/1988 | Wynn | 175/359 |
| 4,765,205 | 8/1988 | Higdon | 76/108 |
| 4,848,491 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett | 175/57 |
| 5,145,016 | 9/1992 | Estes | 175/331 |
| 5,199,516 | 4/1993 | Fernandez | 175/366 |
| 5,224,560 | 7/1993 | Fernandez | 175/374 |
| 5,289,889 | 3/1994 | Gearhart | 175/325.5 |

OTHER PUBLICATIONS

Security/Dresser "Dresser Oilfield Catalog" Rock Bits, Diamond Products, Drilling Tools, *Security Means Technology.*

"State of the Science in Rock Bit Techn." by Carlos Fernandez, SPACEBIT.

*Primary Examiner*—David J. Bagnell
*Assistant Examiner*—Frank S. Tsay
*Attorney, Agent, or Firm*—Baker & Botts

[57] ABSTRACT

A rotary cone drill bit for forming a borehole having a one-piece bit body with a lower portion having a convex exterior surface and an upper portion adapted for connection to a drill string. A number of support arms are preferably attached to the bit body and depend therefrom. Each support arm has an inside surface with a spindle connected thereto and an outer surface. Each spindle projects generally downwardly and inwardly with respect to the associated support arm. A number of cone cutter assemblies equal to the number of support arms are mounted on each of the spindles. The support arms are spaced on the exterior of the bit body to provide enhanced fluid flow between the lower portion of the bit body and the support arms. Also, the length of the support arms is selected to provide enhanced fluid flow between the associated cutter cone assembly and the lower portion of the bit body. The same bit body may be used with various rotary cone drill bits having different gauge diameters.

20 Claims, 4 Drawing Sheets

22
44
42
26
24
40
28
126
20
52
86
84
48
60
46
70
160
70
88
100
102
104
104
102
100

ROCK BIT WITH ENHANCED FLUID RETURN AREA

RELATED APPLICATION

This application is related to copending application entitled *Modular Rotary Drill Bit*, Ser. No. 08/287,446, filed Aug. 8, 1994; copending application entitled *Rotary Cone Drill Bit With Improved Support Arms*, Ser. No. 08/287,441, filed Aug. 8, 1994; copending application entitled *Rotary Drill Bit and Method for Manufacture and Rebuild*, Ser. No. 08/287,340, filed Aug. 8, 1994; copending application entitled *Rotary Drill Bit*, Ser. No. 29/033,594, filed Jan. 17, 1995; and copending application entitled *Support Arm and Rotary Cone for Modular Drill Bit*, Ser. No. 29/033,630, filed Jan. 17, 1995; copending application entitled *Rotary Cone Drill Bit and Method for Enhanced Lifting of Fluids and Cuttings*, Ser. No. 08/351,019, filed Dec. 7, 1994; and copending application entitled *Rotary Cone Drill Bit With Angled Ramps*, Ser. No. 08/350,910, filed Dec. 7, 1994.

TECHNICAL FIELD OF THE INVENTION

This invention relates in general to rotary drill bits used in drilling a borehole in the earth and in particular to a drill bit having a one-piece bit body which enhances fluid flow during drilling operations and substantially reduces restrictions to fluid return from the bottom of the borehole to the well surface.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed from three segments. The segments may be positioned together longitudinally with a weld groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, *Positioning System for Rock Bit Welding* shows a method and apparatus for constructing a three cone rotary rock bit from three individual segments. U.S. Pat. No. 4,054,772 is incorporated by reference for all purposes within this application.

A cutter cone assembly is generally mounted on each spindle and supported rotatably on bearings acting between the spindle and the inside of a spindle receiving cavity or chamber in the cutter cone. One or more nozzle housings may be formed on the bit body adjacent to the support arms. A nozzle is typically positioned within each housing to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cone assemblies, and carrying the cuttings radially outward and then upward within the annulus defined between the exterior of the bit body and the wall of the borehole. U.S. Pat. No. 4,056,153 entitled, *Rotary Rock Bit with Multiple Row Coverage for Very Hard Formations* and U.S. Pat. No. 4,280,571 entitled, *Rock Bit* show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary bits or rock bits, cuttings and other types of debris may collect in downhole locations with restricted fluid flow. Examples of such locations with restricted fluid flow include the lower portion of the bit body adjacent to the respective support arms, the annulus area between the exterior of the bit body and the adjacent wall of the borehole. Other areas of restricted fluid flow may include the backface of the respective cutter cone assemblies, portion of the support arms and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. One aspect of the present invention includes a one-piece or unitary bit body which provides enhanced fluid flow around the exterior of the bit body and associated support arms during drilling operations resulting in enhanced fluid flow for removal of cuttings and other debris from the bottom of the borehole to the well surface. The lower portion of the bit body adjacent to the associated support arms preferably includes a generally convex exterior surface which eliminates stagnation of cuttings and/or drilling fluids above cutter cone assemblies associated with each support arm. The convex surface of the bit body promotes movement of cuttings and other debris radially outward from the cutter cone assemblies towards the wall of the borehole and upward through the annulus formed between the wall of the borehole and the associated drill string.

Another aspect of the present invention includes maintaining the outside diameter of the bit body as small as possible while still providing for standard American Petroleum Institute (API) roller bit connections to attach the associated drill bit with the drill string. By minimizing the outside diameter of the bit body, the fluid flow area between the exterior of the associated rotary cone drill bit and the borehole may be substantially increased. For some applications, the present invention allows an increase of twenty percent (20%) or more in the fluid flow area between the exterior of the bit body and the wall of the borehole as compared with many conventional rotary cone drill bits having the same gauge diameter.

A further aspect of the present invention includes the ability to optimize the position of each support arm and its associated cutter cone assembly to increase fluid flow between the exterior of the bit body and associated portions of the associated cutter cone assembly. Optimizing the location of the cutter cone assemblies relative to the exterior of the associated bit body results in increased fluid flow and movement of cuttings from the space between the lower portion of the bit body and the cutter cone assemblies to the outer portion of the associated rotary drill bit and upwardly through the annulus between the drill string and the wall of the borehole.

Important technical advantages of a one-piece, unitary bit body incorporating the present invention include the ability to position fluid nozzles at various locations within the bit body without affecting the design and position of the associated support arms and/or cutter cone assemblies. Positioning the nozzles and their associated fluid flow passageways within the bit body eliminates the need for nozzle housings or nozzle bosses which are often formed on the exterior of previous rotary drill bits. Such nozzle housings or nozzle bosses substantially reduce the available area for return fluid flow between the exterior of the associate drill bit and the wall of the borehole. Depending upon the intended use of the respective drill bit, the present invention allows the fluid flow from the nozzles to be directed substantially parallel with the projected axis of rotation of the drill string and drill bit. Fluid flow from the nozzles may be directed in between adjacent cutter cone assemblies. Also, the fluid nozzles may be positioned near the center of the associated bit body to prevent fluid exiting the nozzles from interfering with the flow path of fluids returning from the bottom of the borehole with the entrained cuttings.

Further technical advantages of the present invention include providing a one-piece, unitary bit body having a symmetrical enlarged cavity to receive drilling fluids from the associated drill string. One or more fluid passageways are preferably provided to intersect the cavity. The length and diameter of the fluid passageways may be selected for some applications to provide laminar flow to each nozzle which substantially reduces erosion of the nozzles and/or internal surfaces of the bit body. The fluid passageways may be easily machined with a relatively straight, uniform inside diamter.

Another aspect of the present invention includes forming a rotary rock bit from a one piece, unitary bit body having one or more pockets to receive a respective support arm. A spindle is preferably formed as an integral part of each support arm for mounting a cutter cone assembly on each support arm. The present invention allows designing the pockets in the unitary bit body and their associated support arm to position the cutter cone assemblies at the optimum location relative to the bit body and borehole wall for enhanced fluid flow and return of cuttings to the well surface during drilling operations.

Another important technical advantage of the present invention includes providing a rotary cone drill bit having a bit body and support arms which may be formed from different types of material. For example, the bit body may be formed from AISI 8620 alloy steel which minimizes manufacturing costs of the bit body, while providing enhanced downhole performance of the associated drill bit and limits the use of other relatively high cost alloy steel materials to forming only the support arms. Thus, the present invention results in substantially reduced material costs while providing enhanced downhole performance.

BRIEF DESCRIPTION OF THE DRAWINGS

For a more complete understanding of the present invention, and the advantages thereof, reference is now made to the following descriptions taken in conjunction with thee accompanying drawings, in which.

DETAILED DESCRIPTION OF THE INVENTION

Figure 1:
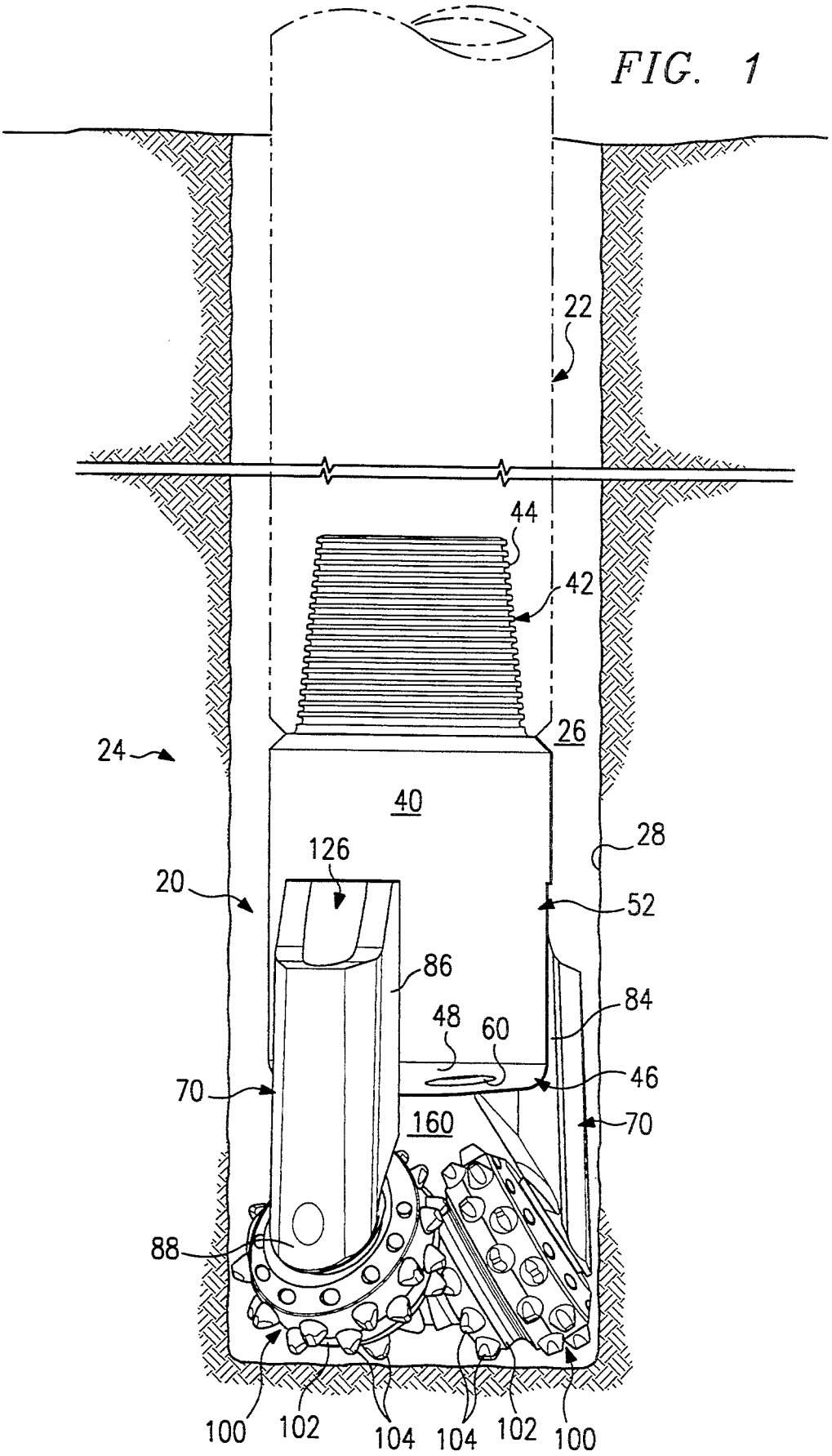
FIG. 1 is a schematic drawing in elevation and section with portions broken away showing a rotary cone drill bit, incorporating features of the present invention attached to one end of a drill string disposed in a borehole.

The preferred embodiments of the present invention and its advantages are best understood by referring to FIGS. 1–9 of the drawings, like numerals being used for like and corresponding parts of the various drawings.

As shown in the drawings for purposes of illustration, the present invention is embodied in rotary cone drill bit 20 of the type used in drilling a borehole in the earth. Rotary cone drill bit 20 may sometimes be referred to as a "rotary drill bit" or "rock bit." Rotary cone drill bit 20 preferably includes threaded connection or pin 44 for use in attaching drill bit 20 with drill string 22. Threaded connection 44 and the corresponding threaded connections (not shown) associated with drill string 22 are designed to allow rotation of drill bit 20 in response to rotation of drill string 22 at the well surface.

As shown in FIG. 1, drill bit 20 may be attached to drill string 22 and disposed in borehole 24. Annulus 26 is formed between the exterior of drill string 22 and the interior or wall 28 of borehole 24. In addition to rotating drill bit 20, drill string 22 is often used to provide a conduit for communicating drilling fluids and other fluids from the well surface to drill bit 20 at the bottom of borehole 24. Such drilling fluids may be directed to flow from drill string 22 to various nozzles 60 provided in drill bit 20. Cuttings formed by drill bit 20 and any other debris at the bottom of borehole 24 will mix with the drilling fluids exiting from nozzles 60 and return to the well surface via annulus 26.

For rotary cone drill bit 20 cutting action or drilling action occurs as cutter cone assemblies 100 are rolled around the bottom of borehole 24 by rotation of drill string 22. The resulting inside diameter of borehole 24 defined by wall 28 corresponds approximately with the combined outside diameter or gauge diameter of cutter cone assemblies 100. Cutter cone assemblies 100 cooperate with each other to form wall 28 of borehole 24 in response to rotation of drill bit 20. Cutter cone assemblies 100 may sometimes be referred to as "rotary cone cutters" or "roller cone cutters".

Figure 2:
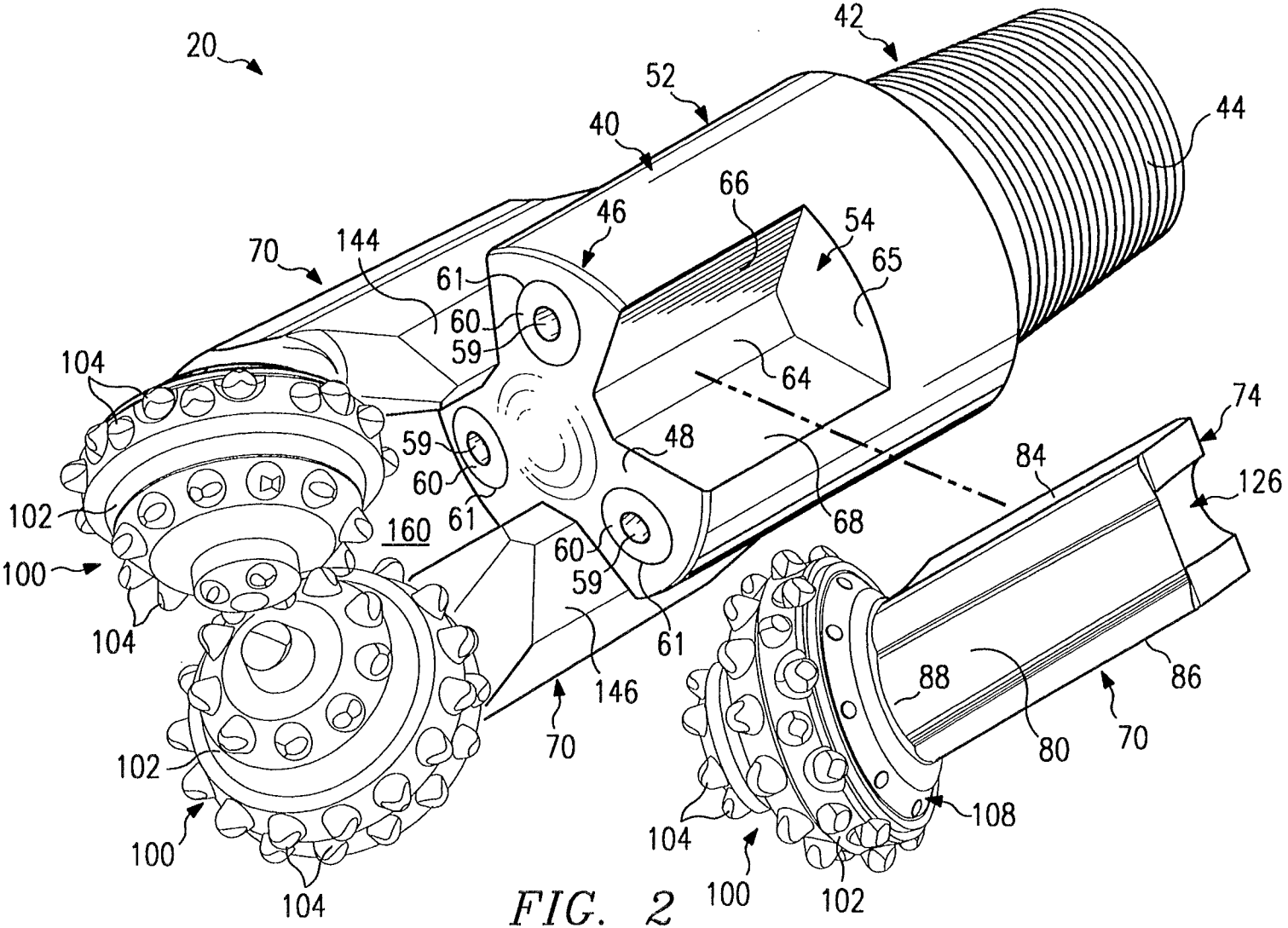
FIG. 2 is an isometric drawing showing a partially exploded view of a rotary cone drill bit incorporating an embodiment of the present invention.
Figure 3:
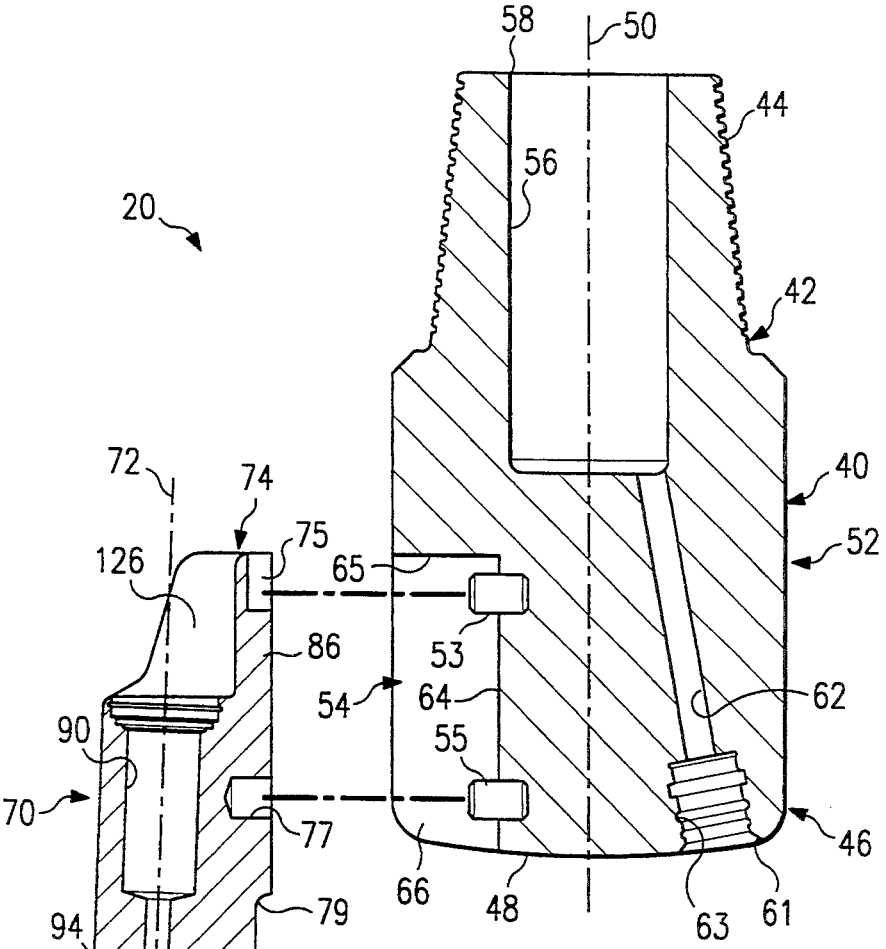
FIG. 3 is an exploded drawing in section showing portions of a one-piece bit body, support arm, and cutter cone assembly incorporating an embodiment of the present invention.

As shown in FIGS. 1, 2, and 3 each cutter cone assembly 100 includes cutting edges 102 with protruding inserts 104 which scrape and gouge against the sides and bottom of borehole 24 in response to the weight and rotation applied to drill bit 20 from drill string 22. The position of cutting edges 102 and inserts 104 for each cutter cone assembly 100 may be varied to provide the desired downhole cutting action. Other types of cutter cone assemblies may be satisfactorily used with the present invention including, but not limited to, cutter cone assemblies having milled teeth instead of inserts 104. Cuttings and other debris created by drill bit 20 may be carried from the bottom of borehole 24 to the well surface by drilling fluids exiting from nozzles 60. The debris carrying fluid generally flows radially outward from beneath drill bit 20 and then flows upward towards the well surface through annulus 26.

Drill bit 20 preferably comprises a one-piece or unitary bit body 40 with upper portion 42 having threaded connection or pin 44 adapted to secure drill bit 20 with the lower end of drill string 22. Three support arms 70 are shown attached to and extend longitudinally from bit body 40 opposite from pin 44. Each support arm 70 preferably includes spindle 82 connected to and extending from inside surface 76 of the respective support arm 70. An important feature of the present invention includes the ability to remove one or more support arms 70 from bit body 40 and to rebuild drill bit 20 using the same bit body 40.

Bit body 40 includes lower portion 46 having a generally convex exterior surface 48 formed thereon. The dimensions of convex surface 48 and the location of cutter cone assemblies 100 are selected to optimize fluid flow between lower portion 46 of bit body 40 and cutter cone assemblies 100. As will be explained later in more detail, the location of cutter cone assemblies 100 relative to lower portion 46 may be varied by adjusting the length of the associated support arms 70 and the spacing between each support arm 70 on the exterior of bit body 40.

As shown in FIGS. 2 and 3, bit body 40 includes middle portion 52 disposed between upper portion 42 and lower portion 46. Longitudinal axis or central axis 50 extends through bit body 40 and corresponds generally with the projected axis of rotation for drill bit 20. Middle portion 52 preferably has a generally cylindrical configuration with pockets 54 formed in the exterior thereof and spaced radially from each other. The number of pockets 54 is selected to correspond with the number of support arms 70 which will be attached thereto. The spacing between pockets 54 in the exterior of middle portion 52 is selected to correspond with any desired spacing between support arms 70 and their associated cutter cone assemblies 100. The location of pockets 54 may also be varied to provide any desired offset for cutter cone assemblies 100 with respect to longitudinal axis 50 and the projected axis of rotation for drill bit 20.

Each support arm 70 has a longitudinal axis 72 extending therethrough. Support arms 70 are preferably mounted in their respective pockets 54 with their respective longitudinal axis 72 aligned parallel with each other and with longitudinal axis 50 of the associated bit body 40. For one application a portion of each support arm 70 is preferably welded within its associated pocket 54 by a series of welds formed between the exterior or perimeter of each pocket 54 and adjacent portions of the associated support arm 70. The perimeter of each pocket 54 adjacent to the exterior of bit body 40 may be modified to provide welding surfaces and/or welding grooves to assist in attaching each support arm 70 with its associated pocket 54.

FIG. 3 is an exploded drawing which shows the relationship between bit body 40, one of the support arms 70 and its associated cutter cone assembly 100. Each cutter cone assembly 100 is preferably constructed and attached to its associated spindle 82 in a substantially identical manner. Each support arm 70 is preferably constructed and mounted in its associated pocket 54 in substantially the same manner. Therefore, only one support arm 70 and cutter cone assembly 100 will be described in detail since the same description applies generally to the other two support arms 70 and their associated cutter cone assemblies 100.

Support arm 70 has a generally rectangular configuration with respect longitudinal axis 72. Support arm 70 may have various cross-sections taken normal to longitudinal axis 72 depending upon the configuration of the associated pocket 54 and other features which may be incorporated into support arm 70 in accordance with the teachings of the present invention. Support arm 70 includes top surface 74, inside surface 76, bottom edge 78 and exterior surface 80. Support arm 70 also includes sides 84 and 86 which preferably extend substantially parallel with longitudinal axis 72.

Various features of the present invention may be incorporated as part of inside surface 76, exterior surface 80 and sides 84 and 86. The various dimensions of each support arm 70 are selected to be compatible with the associated pocket 54. As shown in FIGS. 2 and 3, a portion of each support arm 70 including upper end or top surface 74 and adjacent portions of inside surface 76 along with sides 84 and 86 extending therefrom, are sized to fit within the associated pocket 54.

As will be explained later in more detail, inside surface 76 may be modified as desired to provide various features of the present invention. The configuration of inside surface 76 may be varied substantially between top surface 74 and bottom edge 78. Also, the configuration of inside surface 76 with respect to sides 84 and 86 may be varied depending upon the configuration of the associated pockets. Inside surface 76 and exterior surface 80 are contiguous at bottom edge 78 of support arm 70. The portion of exterior surface 80 formed adjacent to bottom edge 78 is often referred to as shirttail surface 88.

For one embodiment of the present invention, first opening 75 and second opening 77 are formed in inside surface 76 of each support arm 70. First post 53 and second post 55 may be formed on back wall 64 of each pocket 54. Post 53 and 55 extend readily from each back wall 64 to cooperate respectfully with first opening 75 and second opening 77 to position each support arm 70 within its associated pocket 54. For some applications, first opening 75 preferably comprises a longitudinal slot extending from top surface 74 and size to receive first post 53 therein. Second opening 77 preferably has a generally circular configuration to receive second post 55 therein. Posts 53 and 55 and openings 75 and 77 may be used to position each support arm 70 within the associated pocket 54 prior to welding.

Spindle 82 is preferably angled downwardly and inwardly with respect to both longitudinal axis 72 of support arm 70 and the projected axis of rotation of drill bit 20. This orientation of spindle 82 results in the exterior of cutter cone assembly 100 engaging the side and bottom of borehole 24 during drilling operations. For some applications, it may be preferably to position each support arm 70 and its associated spindle 82 with cutter cone assembly 100 at an offset from the projected axis of rotation of drill bit 20. The desired offset can be easily obtained by forming the associated pockets 54 in the exterior of bit body 40 with a corresponding offset from longitudinal axis 50 of bit body 40. The amount of offset may vary from zero to five or six degrees (6°) or approximately zero (0) inches to one half (½) inch in the direction of rotation of drill bit 20.

As shown in FIGS. 1, 2 and 3, each cutter cone assembly 100 includes base portion 108 with a conically shaped shell or tip 106 extending therefrom. For some applications, base portion 108 includes a frustroconically shaped outer surface 110 which is preferably angled in a direction opposite from the angle of shell 106. Base 108 also includes backface 112 which may be disposed adjacent to portions of inside surface 76 of the associated support arm 70. Base 108 preferably includes opening 120 with chamber 114 extending therefrom. Chamber 114 extends through base 108 and into shell 106. The dimensions of opening 120 and chamber 114 are selected to allow mounting each cutter cone assembly 100 on its associated spindle 82. One or more bearing assemblies 122 may be mounted on spindle and disposed between a bearing wall within chamber 114 and annular bearing surface 81 on spindle 82. A conventional ball retaining system 124 may be used to secure cutter cone assembly 100 to spindle 82.

Cutter cone assembly 100 may be manufactured of any hardenable steel or other high strength engineering alloy which has adequate strength, toughness, and wear resistance to withstand the rigors of downhole drilling. Protection of bearing assembly 122 and any other bearings within chamber 114, which allow rotation of cutter cone assembly 100 can lengthen the useful service life of drill bit 20. Once drilling debris is allowed to infiltrate between the bearing surfaces of cutter cone assembly 100 and spindle 82, failure of drill bit 20 will follow shortly. The present invention provides enhanced fluid flow around the exterior of drill bit 20 and the associated support arms 70 and cutter cone assemblies 100 to help keep debris from entering between the various bearing surfaces of each cutter cone assembly 100 and its associated spindle 82. Often an elastomeric seal such as seal 116 may be disposed within the gap between the bearing surfaces of cutter cone assembly 100 and its associated spindle 82. However, once seal 116 fails, drilling fluids and other debris can quickly contaminate the bearing surfaces via the gap between cutter cone assembly 100 and its associated spindle 82.

For some applications, bit body 40 may be fabricated or machined from a generally cylindrical, solid piece of raw material or bar stock (not shown) having the desired metallurgical characteristics for the resulting drill bit 20. AISI 8620 alloy steel is an example of the type of material which may be used to form bit body 40.

Threaded connection 44 may be formed on upper portion 42 of bit body 40 using conventional threading techniques. One of the primary requirements in determining the outside diameter of middle portion 52 of bit body 40 is the amount of material thickness required to provide threaded connection 44. The following API table for roller bit connections shows various sizes of drill bits and the required pin size.

ROLLER BIT CONNECTIONS

| 1 Size of Bit, inches | 2 Size and Style of Rotary Pin Connection | 3 Bit Sub Bevel Dia. ± 1/64 inches | 4 Bit Sub Bevel Dia. ± 1/64 inches |
|---|---|---|---|
| 3 3/4 to 4 1/2, incl. | 2 3/8 REG | 3 3/64 | 3 5/64 |
| 4 5/8 to 5, incl. | 2 7/8 REG | 3 39/64 | 3 11/64 |
| 5 1/8 to 7 3/8, incl. | 3 1/2 REG | 4 7/64 | 4 9/64 |
| 7 1/2 to 9 3/8, incl. | 4 1/2 REG | 5 21/64 | 5 23/64 |
| 9 1/2 to 14 1/2, incl. | 6 5/8 REG | 7 23/64 | 7 25/64 |
| 14 5/8 to 18 1/2, incl. | 7 5/8 REG | 8 15/32 | 8 1/2 |
| 18 5/8 and larger | 8 5/8 REG | 9 35/64 | 9 37/64 |

The size of drill bit 20 is determined by the maximum outside diameter or gauge diameter associated with the three cutter cone assemblies 100. The position of each cutter cone assembly 100 and their combined gauge diameter relative to the projected axis of rotation of drill bit 20 is a function of the dimensions of pockets 54 and their associated support arms 70 with cutter cone assemblies 100 mounted respectively thereon.

Support arms 70 having various sizes of cutter cone assemblies 100 may be attached to pockets 54 to provide the desired size for drill bit 20. The dimensions of spindle 82 are preferably selected to accommodate both the largest and smallest cutter cone assembly 100 which will be mounted on the associated support arm 70. Thus, the same one-piece bit body 40 having threaded connection 44 appropriate for a 7½ inch drill bit may also be used for a 9⅜ inch drill bit or any drill bit size therebetween. It is important to note that as the drill bit size increases from 7½ inches to 9⅜ inches, the outside diameter of middle portion 52 of bit body 40 can remain essentially the same. Therefore, the flow area in annulus 26 between the exterior of bit body 40 and wall 28 of borehole 24 is substantially enhanced for a 9⅜ inch drill bit as compared to a 7½ inch drill bit.

Figure 5:
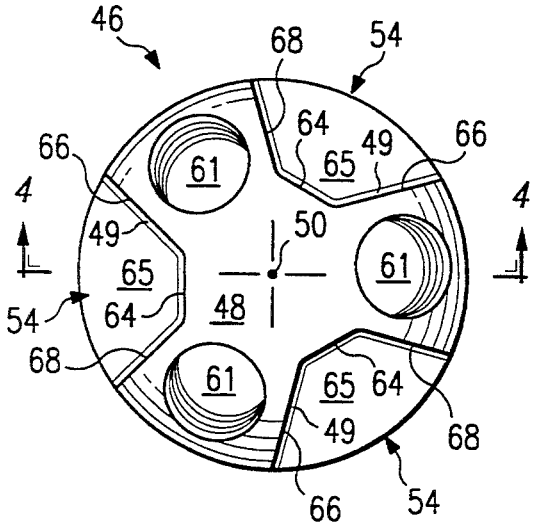
FIG. 5 is an end view of the bit bodies shown in FIG. 3 and in FIG. 4.

As best shown in FIGS. 2, 3 and 5, each pocket 54 includes back wall 64 and a pair of side walls 66 and 68. The dimensions of back wall 64 and side walls 66 and 68 are selected to be compatible with the adjacent inside surface 76 and sides 84 and 86 of the associated support arm 70. For one application, side walls 66 and 68 are formed at an angle of forty five degrees (45°) relative to back wall 64. Also, each pocket 54 preferably includes upper surface 65 formed as an integral part thereof to engage top surface 74 of the associated support arm 70. For some applications, a welding groove 49 may be formed in the perimeter of each pocket 54 at the intersection between each pocket 54 and convex surface 48 on lower portion 46 of bit body 40.

The width ($W_p$) of each pocket is selected to accommodate the associated support arm 70. An important feature for one embodiment of the present invention includes limiting width of support arms 70. By limiting the width of support arms 70, sufficient void spaces 160 are provided between adjacent support arms 70 to allow for enhanced fluid flow between support arms 70 and convex surface 48 on lower portion 46 of bit body 40.

Another important feature of the present invention includes the ability to vary the length of support arm 70 to provide the desired fluid flow between the associated cutter cone assembly 100 mounted on each support arm 70 and convex surface 48 on lower portion 46 of bit body 40. For one application, the length of support arm 70 from top surface 74 to bottom edge 78 is preferably selected to be at least three times the width of support arm 70. Often, it is desirable to provide at least one half (½) inch of clearance between the upper portion of each cutter cone assembly 100 and the adjacent portion of convex surface 48.

As shown in FIG. 3, enlarged cavity 56 may be formed within upper portion 42 of bit body 40. Opening is provided in upper portion 42 for communicating fluids between drill string 22 and cavity 56. Cavity 56 preferably has a generally uniform inside diameter extending from opening 58 to a position intermediate middle portion 52 of bit body 40. For some applications, cavity 56 may be formed concentric with longitudinal axis 50 of bit body 40.

One or more fluid passageways 62 may be formed in bit body 40 extending between cavity 56 and convex surface 48 on lower portion 46 of bit body 40. Opening 61 may be provided in each fluid passageway 62 adjacent to convex surface 48. A plurality of recesses 63 are preferably provided within each opening 61 to allow installing various types of nozzles or nozzle inserts 60 within each fluid passageway 62. Additional components (not shown) such as a snap ring and/or O-ring seal may be provided to position each nozzle insert 60 within recesses 63. Various techniques are commercially available for satisfactorily installing nozzle 60 within its associated opening 61. For some applications, nozzle inserts 60 may be formed from tungsten carbide or other suitable materials to resist erosion from fluids flowing therethrough. Also, one or more access ports (not shown) may be provided in bit body 40 adjacent to openings 61 to allow lock screws or pins and/or plug welds (not shown) to secure nozzle insets 60 within recesses 63.

Nozzles 60 preferably include one or more outlet orifices 59. Nozzles 60 may be disposed in each fluid passageway 62 to regulate fluid flow from cavity 56 through the respective fluid passageway 62 and the associated nozzle 60 to the exterior of bit body 40. The length and diameter of each fluid passageway 62 may be selected for some applications to provide laminar flow between cavity 56 and the respective nozzle 60. The present invention allows forming fluid passageway 62 with a diameter larger than previously possible with conventional rotary cone drill bits. The straight, large inside diameter of passageways 62 will minimize erosion or washout of nozzles 60.

An important feature of the present invention includes the ability to vary the position of fluid passageways 62 and associated nozzles 60 within bit body 40 without affecting the location of pockets 54 and the associated support arms 70. Bit bodies 140, 240 and 340, which will be described later in more detail, show various examples of different locations for fluid passageways 62 and their associated nozzles 60 within the respective bit body in accordance with the teachings of the present invention. FIG. 5 shows lower portion 46 which is representative of both bit body 40 and bit body 140. Lower portion 46 is shown with three pockets 54 and three openings 61 for associated fluid passageways 62 spaced radially with respect to each other around the perimeter of both bit bodies 40 and 140. For the specific example shown in FIG. 5, fluid passageways 62 and associated openings 61 are spaced radially approximately one hundred twenty degrees (120°) from each other. In a similar manner, each support pocket 54 is spaced radially approximately one hundred twenty degrees (120°) from an adjacent pocket 54.

Figure 4:
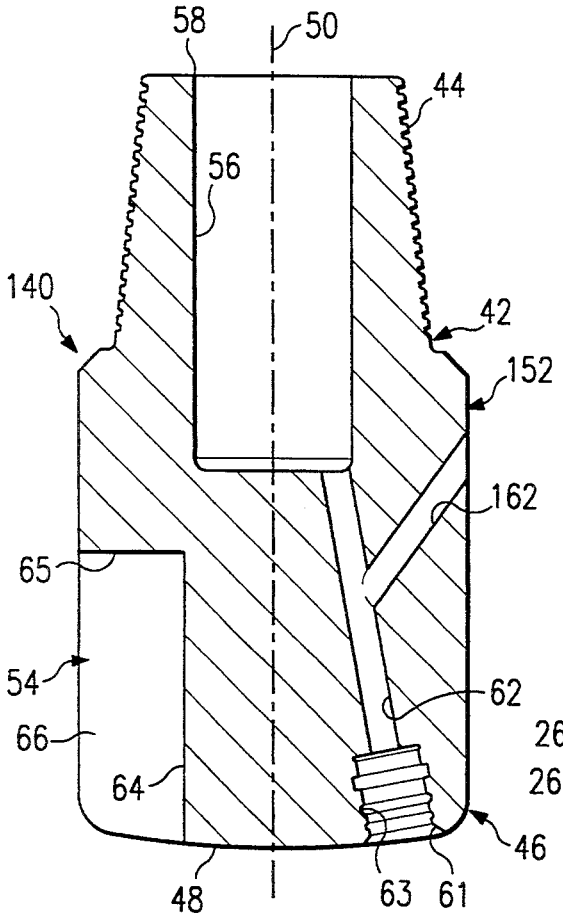
FIG. 4 is a drawing in section showing a one-piece bit body incorporating another embodiment of the present invention.

Another embodiment of the present invention is represented by bit body 140 shown in FIG. 4. Bit body 140 is essentially the same as previously described bit body 40 with the exception of fluid passageway 162. Bit body 140 includes cavity 56 with first fluid passageway 62 extending therefrom. A second passageway 162 may be formed in bit body 140 extending between first passageway 62 and the exterior of middle portion 152 of bit body 140. Second passageway 162 is preferably formed at an acute angle with respect to first passageway 62 such that any fluid exiting from second fluid passageway 162 will assist with fluid flow in annulus 26 between the exterior of drill bit 20 and wall 28 of borehole 24.

For some applications, an appropriately sized plug (not shown) may be placed in opening 61 to direct all fluid flow from cavity 56 through first fluid passageway 62 and upwardly through second fluid passageway 162 to the exterior of middle portion 152 of bit body 140. For other applications, nozzle 60 with an appropriately sized orifice (not shown) may be disposed within recesses 63 of opening 61 to control or regulate the amount of fluid exiting from first fluid passageway 62 and second fluid passageway 162. Also, a second nozzle (not shown) may be disposed in second fluid passageway 162. The present invention allows installing multiple fluid passageways and nozzles at various locations within the associated bit body to enhance fluid flow from the bottom of well bore 24 through annulus 26 to the well surface. If desired, multiple passageways 162 may be formed in bit body 140.

Figure 8:
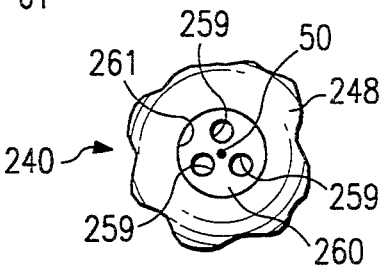
FIG. 8 is a partial end view of the bit body shown in FIGS. 6 and 7.
Figure 6:
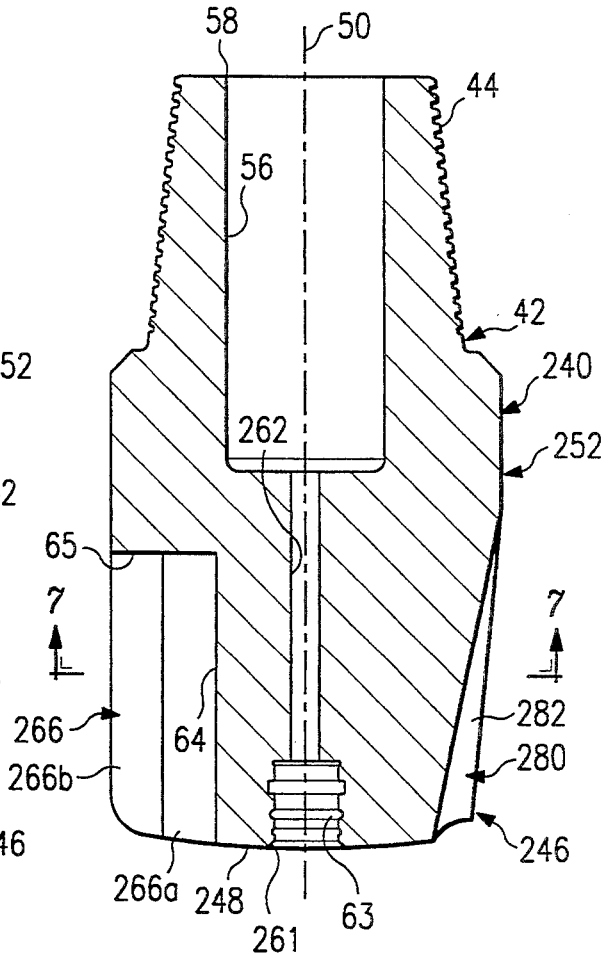
FIG. 6 is a drawing in section showing a one-piece bit body incorporating a further embodiment of the present invention.

A further embodiment of the present invention represented by bit body 240 shown in FIG. 6 includes modified pockets 254 and fluid passageway 262 which extends substantially parallel to and concentric with longitudinal axis 50 of the associated bit body 240. Nozzle 60 with one or more outlet orifices 59 may be disposed within fluid passageway 262 proximate the intersection of the associated convex surface 248 and longitudinal axis 50 of bit body 140. For example, FIG. 8 shows a partial end view of bit body 240 and convex surface 248 having nozzle 260 installed within opening 261. As shown in FIG. 8, nozzle 260 preferably includes three orifices 259 positioned regularly with respect to each other and longitudinal axes 50 of bit body 240. For other applications, it may be desirable to position outlet orifices 259 in nozzle 260 relatively close to each other corresponding to only one sector of the associated fluid passageway 262.

As shown in FIG. 6, bit body 240 preferably includes upper portion 42 as previously described for bit body 40. Middle portion 252 and lower portion 246 of bit body 240 have been modified as compared to middle portion 52 and lower portion 46 of bit body 40. Lower portion 246 preferably includes convex surface 248 similar to convex surface 48 of bit body 240, except for the configuration of pockets 254, opening 261 for nozzle 260 and cutouts 280. As previously noted, one of the differences between bit body 40 and bit body 240 includes forming fluid passageway 262 essentially parallel with and concentric to longitudinal axis 50. In addition, a number of angularly-spaced cutouts 270 may be formed in the exterior of bit body 240 intermediate pockets 54. Placing fluid passageway 262 essentially concentric with longitudinal axis 50 allows reducing the outside diameter of bit body 140 and/or providing cutouts 280.

Cutouts 280 may extend from lower portion 246 of bit body 240 to a position intermediate the exterior of middle portion 252. Each cutout 280 is defined in part by a tapered surface 282 which extends radially outward from lower portion 246 of bit body 240 to provide enhanced fluid flow from beneath lower portion 246 of bit body 240 to the exterior of the associated drill bit 20. Pockets 254 and cutouts 280 are preferably formed in an alternating arrangement around the perimeter of bit body 240 and spaced radially from each other. For the example shown in FIG. 7, the center line of each pocket 254 is preferably formed at an angle of one hundred twenty degrees (120°) with respect to each other. In a similar manner, the center line of each cutout 280 is preferably formed at an angle of one hundred twenty degrees (120°) with respect to each other.

Figure 7:
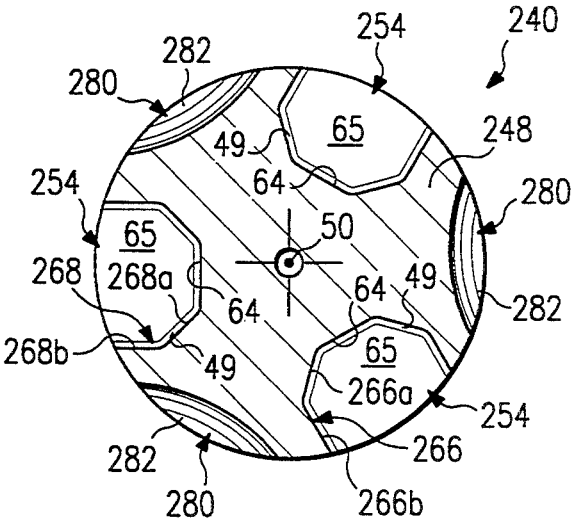
FIG. 7 is a drawing in section taken along lines 7—7 of FIG. 6.

Pockets 254 of bit body 240 are similar to previously described pockets 54 of bit body 40, except for modified side walls 266 and 268. As best shown in FIG. 7, side wall 266 includes a first portion **266*a* extending at an angle of approximately forty five degrees (45°) relative to back wall 64 and a second portion 266*b* extending from first portion 266*a* at an angle of approximately ninety degrees (90°) relative to back wall 64. Side wall 268 includes a similar first portion 268*a* and a second portion 268*b*. Second portions 266*b* and 268*b*** are disposed substantially parallel with each other.

Figure 9:
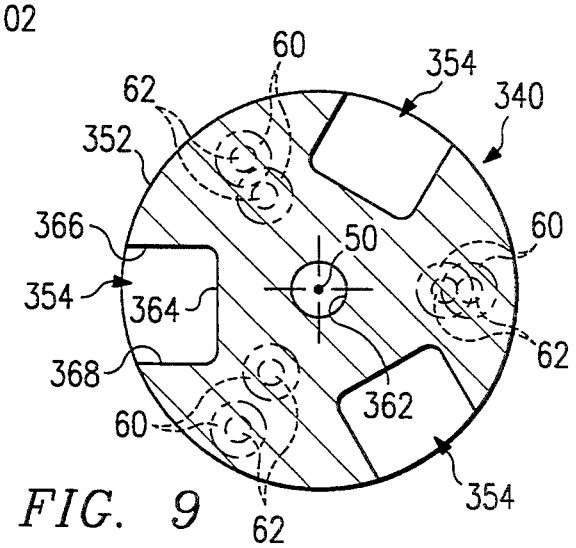
FIG. 9 is a drawing in section of a bit body showing an alternative pocket configuration and alternative locations for fluid nozzles in accordance with the present invention.

Further alternative embodiments of the present invention are shown in FIG. 9 as represented by bit body 340. FIG. 9 is a sectional view of middle portion 352 for bit body 340 showing alternative locations for fluid passageways 62 and openings 61 extending between cavity 56 (not shown in FIG. 8) and the exterior of bit body 340. Bit body 340 also includes pockets 354 having a generally square configuration as compared to pockets 54.

An important benefit of the present invention includes the ability to vary the position of the respective fluid passageways 62 and their associated nozzles 60 to direct drilling fluid flow from cavity 56 to exit the associated bit body as desired. For some applications, fluid passageways 62 and their associated nozzles 60 may be located to direct fluid flow between adjacent cutter cone assemblies 100 extending from bit body 340. Also, the location of selected fluid passageways 62 and their associated nozzles 60 may be varied to adjust the angle at which fluid exiting from the respective nozzle 60 intersects with wall 28 and/or the bottom of borehole 24. For boreholes having a diameter of seven inches (7") to eight inches (8") fluid flow from nozzles 60 may be direct to intersect the bottom of borehole 24 approximately one inch (1") in front wall 28. The present invention allows varying the intersection between fluid flow from nozzles 60 and the bottom of borehole 24 depending upon the diameter of the respective borehole and other downhole conditions. For purposes of illustration, bit body 340 is also shown with fluid passageway 362 extending substantially parallel with the longitudinal axis of bit body 340.

Various locations for fluid passageways 62 may be selected without requiring any change in the location of pockets 354 formed in the exterior of bit body 340. Positioning nozzles 60 and their associated fluid passageways 62 relatively close to longitudinal axis 50 will minimize interference between fluids exiting nozzles 60 and return fluid flow with entrained cuttings. Welding procedures associated with forming a prior art bit body from three segments substantially limited the number of nozzles and locations available for installing fluid nozzles.

As previously noted, an important feature of the present invention includes the ability to vary the number and location of fluid passageways 62, 262 and 362 and/or the location of the associated fluid nozzles 60 to provide enhanced fluid flow with respect to the associated cutter cone assemblies 100 and the lower portion of the associated bit body 40, 140, 240 and 340. With respect to bit body 240 shown in FIGS. 6 and 7, the present invention allows positioning nozzle 60 at approximately the intersection of convex surface 248 on lower portion 246 of bit body 240 and longitudinal axis 50 which extends through bit body 240.

Still another important feature of the present invention includes the ability to vary the configuration of the pockets formed in the exterior of the associated bit body. For example, bit body 340 is shown in FIG. 9 having pockets 354 with a generally square configuration. The width of each pocket 354 is defined by the distance between the associated side walls 366 and 368. For this embodiment of the present invention, the combined width ($W_p$) of pockets 354 is preferably limited to less than one half ($\frac{1}{2}$) the circumference of the associated bit body 340. Also, the width ($W_p$) of each pocket 354 is preferably less than the circumferential distance on the exterior of bit body 340 between adjacent pockets 354. By limiting the width of pockets 354, sufficient void space will be provided between the support arms associated with each pocket 354 to allow for enhanced fluid flow around the exterior of the resulting drill bit.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, comprising:

a one-piece bit body having an upper portion adapted for connection to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equal to said number of support arms and mounted respectively on one of said spindles; and said bit body having a lower portion with a generally convex exterior surface formed thereon to provide enhanced fluid flow between said cutter cone assemblies and said lower portion of said bit body.

2. The drill bit as defined by claim 1 wherein said one-piece bit body further comprises:

a middle portion disposed between said upper portion and said lower portion of said bit body;

said middle portion having a generally cylindrical configuration;

a number of pockets formed in the exterior of said middle portion of said bit body for attaching said support arms to said bit body with said number of pockets equalling said number of support arms; and said pockets spaced from each other on the exterior of said middle portion.

3. The drill bit as defined by claim 1 wherein said bit body further comprises:

a middle portion disposed between said upper portion and said lower portion of said bit body;

said middle portion having a generally cylindrical configuration;

a number of pockets formed in the exterior of said middle portion of said bit body for attaching said support arms to said bit body with said number of pockets equalling said number of support arms; and a number of cutouts formed in the exterior of said bit body intermediate said pockets.

4. The drill bit as defined by claim 3 further comprising:

said cutouts extending from said lower portion of said bit body to a position intermediate the exterior of said middle portion of said bit body;

each of said cutouts defined in part by a surface which is tapered radially outward from said lower portion of said bit body to provide enhanced fluid flow from beneath said lower portion of said bit body to said exterior of said drill bit; and said number of cutouts equalling said number of pockets and support arms.

5. The drill bit as defined by claim 1 further comprising:

said bit body having a longitudinal axis corresponding generally with the projected axis of rotation of said drill bit;

an enlarged cavity formed within said upper portion of said bit body;

an opening in said cavity for communicating fluids between said drill string and said cavity;

at least one fluid passageway formed in said bit body extending between said cavity and said lower portion of said bit body; and a nozzle disposed in said fluid passageway adjacent to said lower portion of said bit body.

6. The drill bit as defined by claim 5 further comprising:

said fluid passageway extending substantially parallel with said longitudinal axis of said bit body; and said nozzle positioned proximate the intersection of said convex surface on said lower portion of said bit body and said longitudinal axis of said bit body.

7. The drill bit as defined by claim 5 further comprising:

said fluid passageway extending through said bit body at an angle relative to the longitudinal axis of said bit body; and said nozzle positioned in said fluid passageway to direct fluid flow between said cutter cone assemblies.

8. The drill bit as defined in claim 5 wherein said cavity further comprises a generally uniform inside diameter extending from said opening to a position intermediate said middle portion of said bit body along said longitudinal axis of said bit body.

9. The drill bit as defined in claim 8 further comprising:

said fluid passageway extending substantially parallel with said longitudinal axis of said bit body;

a nozzle positioned within said fluid passageway adjacent to said lower portion of said bit body; and said nozzle having three outlet orifices positioned radially from each other and said longitudinal axis of said bit body.

10. The drill bit as defined in claim 5 further comprising:

a first fluid passageway formed in said bit body extending between said cavity and said lower portion of said bit body;

a second fluid passageway formed in said bit body extending between said first fluid passageway and said exterior of said middle portion of said bit body; and said second passageway formed at an angle with respect to said first fluid passageway whereby any fluid exiting from said second passageway will assist fluid flow in an annulus defined in part by said drill bit and the said borehole.

11. A rotary cone drill bit for forming a borehole having a side wall and bottom comprising:

a one-piece bit body having an upper portion formed as an integral part thereof with a threaded roller bit connection formed on the exterior of said upper portion for connecting said drill bit to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equally said number of support arms with one of said cutter cone assemblies mounted respectively on each spindle for boring engagement with said side wall and bottom of said borehole;

said bit body having a lower portion with a generally convex exterior surface formed thereon to provide enhanced fluid flow between said cutter cone assemblies and said lower portion of said bit body;

a middle portion disposed between said upper portion and said lower portion of said bit body; and said middle portion having a generally cylindrical configuration with said support arms attached thereto.

12. The drill bit as defined by claim 11 wherein said bit body further comprises:

a number of pockets formed in the exterior of said middle portion of said bit body and spaced from each other for use in attaching said support arms to said bit body with said number of pockets equalling said number of support arms; and each of said pockets having an upper surface formed as an integral part thereof for engagement with a top surface provided on its associated support arm.

13. The drill bit as defined by claim 11 further comprising:

each support arm having a longitudinal axis;

the length of said longitudinal axis selected to position said cutter cone assembly mounted on each support arm at the optimum location for enhanced fluid flow between said cutter cone assembly and said lower portion of said bit body; and each support arm having a width less than the circumferential distance on the exterior of said middle portion between adjacent support arms to provide enhanced fluid flow between said support arms disposed in said pockets and said lower portion of said bit body.

14. The rotary cone drill bit as defined by claim 11 further comprising:

said middle portion of said bit body having an outside diameter;

said upper portion of said bit body having an outside diameter compatible with said threaded roller bit connection formed thereon; and said outside diameter of said upper portion approximately equal to said outside diameter of said middle portion and said outside diameter approximately equal to the minimum API diameter required for said threaded roller bit connection.

15. The drill bit as defined by claim 11 further comprising:

a number of pockets formed in the exterior of said middle portion of said bit body for use in attaching said support arms to said bit body with said number of pockets equal to said number of support arms; and each support arm having a longitudinal axis with approximately one third of the length of each support arm disposed in its associated pocket.

16. A rotary cone drill bit for forming a borehole having a side wall and bottom comprising:

a one-piece bit body having an upper portion with a threaded roller bit connection formed on the exterior of said upper portion for connecting said drill bit to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equal to said number of support arms with one of said cutter cone assemblies mounted respectively on each spindle for boring engagement with said side wall and bottom of said borehole;

said bit body having a lower portion with a generally convex exterior surface formed thereon to provide enhanced fluid flow between said cutter cone assemblies and said lower portion of said bit body;

a middle portion disposed between said upper portion and said lower portion of said bit body, said middle portion having a generally cylindrical configuration with an outside diameter based in part on the required dimensions for said threaded roller bit connection;

a number of pockets formed in the exterior of said middle portion of said bit body for attaching said support arms to said bit body with said number of pockets equalling said number of support arms; and said pockets equally spaced around the perimeter of said middle portion.

17. The drill bit as defined by claim 16 further comprising:

each support arm having a longitudinal axis;

the length of each support arm selected to position said cutter cone assembly mounted on each support arm at the optimum location for enhanced fluid flow between said cutter cone assembly and said lower portion of said bit body;

each support arm having a width selected to be compatible with the width of said associated pocket; and the combined width of said support arms selected to be less than one half the circumferential distance on the exterior of said middle portion of said bit body to provide enhanced fluid flow between said support arms and said lower portion of said bit body.

18. The rotary cone drill bit as defined by claim 16 further comprising:

said middle portion of said bit body having an outside diameter; and said bit body and said threaded roller bit connection cooperating with each other to allow attaching support arms and cutter cone assemblies with various dimensions to said bit body without requiring an increase of said outside diameter of said middle portion of said bit body.

19. The drill bit as defined by claim 16 further comprising:

said bit body having a longitudinal axis corresponding generally with the projected axis of rotation of said drill bit;

an enlarged cavity formed within said upper portion of said bit body;

an opening in said cavity for communicating fluids between said drill string and said cavity;

at least one fluid passageway formed in said bit body extending between said cavity and said lower portion of said bit body; and a nozzle disposed in said fluid passageway adjacent to said lower portion of said bit body.

20. The drill bit as defined by claim 16 further comprising:

said fluid passageway extending through said bit body at an angle relative to the longitudinal axis of said bit body; and said nozzle positioned in said fluid passageway to direct fluid flow between said cutter cone assemblies.

* * * * *

US005439067B1

REEXAMINATION CERTIFICATE (3150th)

United States Patent [19]

Huffstutler

[11] B1 5,439,067

[45] Certificate Issued Mar. 4, 1997

[54] ROCK BIT WITH ENHANCED FLUID RETURN AREA

[75] Inventor: Alan D. Huffstutler, Grand Prairie, Tex.

[73] Assignee: Dresser Industries, Inc., Dallas, Tex.

Reexamination Request:
No. 90/004,217, Apr. 8, 1996

Reexamination Certificate for:

| | |
|---|---|
| Patent No.: | **5,439,067** |
| Issued: | **Aug. 8, 1995** |
| Appl. No.: | **287,457** |
| Filed: | **Aug. 8, 1994** |

[51] Int. Cl.[6] ..... E21B 10/18; E21B 10/20

[52] U.S. Cl. ..... 175/339; 175/357

[58] Field of Search ..... 175/105, 331, 175/339, 342, 346, 353, 357, 363

[56] References Cited

U.S. PATENT DOCUMENTS

| | | | |
|---|---|---|---|
| Re. 32,495 | 9/1987 | Coates | 175/339 |
| D. 265,205 | 6/1982 | Munson | D15/139 |
| 2,176,358 | 9/1939 | Pearce | 255/71 |
| 2,260,487 | 10/1941 | Scott | 255/71 |
| 2,634,105 | 4/1953 | Gruner | 255/71 |
| 2,807,444 | 9/1957 | Reifschneider | 255/313 |
| 2,950,090 | 8/1960 | Swart | 255/314 |
| 3,130,801 | 4/1964 | Schumacher, Jr. | 175/374 |
| 3,442,342 | 5/1969 | McElya et al. | 175/374 |
| 4,098,448 | 7/1978 | Sciaky et al. | 228/102 |
| 4,145,094 | 3/1979 | Vezirian | 308/8.2 |
| 4,187,743 | 2/1980 | Thomas | 76/108 A |
| 4,209,124 | 6/1980 | Baur et al. | 228/182 |
| 4,256,194 | 3/1981 | Varel | 175/375 |
| 4,258,807 | 3/1981 | Fischer et al. | 175/375 |
| 4,624,329 | 11/1986 | Evans et al. | 175/374 |
| 4,635,728 | 1/1987 | Harrington | 166/341 |
| 4,657,091 | 4/1987 | Higdon | 175/229 |
| 4,765,205 | 8/1988 | Higdon | 76/108 |
| 4,813,502 | 3/1989 | Dysart | 175/337 |
| 4,817,851 | 4/1989 | Hill | 228/114 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,281,260 | 1/1994 | Kimar et al. | 75/240 |
| 5,351,768 | 10/1994 | Scott et al. | 175/374 |
| 5,439,068 | 8/1995 | Huffstutler | 175/356 |

FOREIGN PATENT DOCUMENTS

| | | | |
|---|---|---|---|
| 936382 | 12/1955 | Germany . | |
| 533719 | 10/1976 | U.S.S.R. | E21B 9/02 |
| 732483 | 11/1977 | U.S.S.R. | E21B 9/10 |
| 1305295 | 4/1986 | U.S.S.R. | E21B 10/30 |
| 1467157 | 3/1989 | U.S.S.R. | E21B 10/26 |

OTHER PUBLICATIONS

International Application No. PCT/US95/10015 Search Report dated Jan. 4, 1996.

Security Oil Field Catalog, *Rock Bits Diamond Products Drilling Tool*, 2 pages (undated).

Carlos Fernandez, *Space Bit, State of the Science in Rock Bit Tech.* (Date appearing on illustration Aug. 8, 1991).

Brochure, Security DBS, *New ERA™ Series*, 1995.

(List continued on next page.)

*Primary Examiner*—Frank S. Tsay

[57] ABSTRACT

A rotary cone drill bit for forming a borehole having a one-piece bit body with a lower portion having a convex exterior surface and an upper portion adapted for connection to a drill string. A number of support arms are preferably attached to the bit body and depend therefrom. Each support arm has an inside surface with a spindle connected thereto and an outer surface. Each spindle projects generally downwardly and inwardly with respect to the associated support arm. A number of cone cutter assemblies equal to the number of support arms are mounted on each of the spindles. The support arms are spaced on the exterior of the bit body to provide enhanced fluid flow between the lower portion of the bit body and the support arms. Also, the length of the support arms is selected to provide enhanced fluid flow between the associated cutter cone assembly and the lower portion of the bit body. The same bit body may be used with various rotary cone drill bits having different gauge diameters.

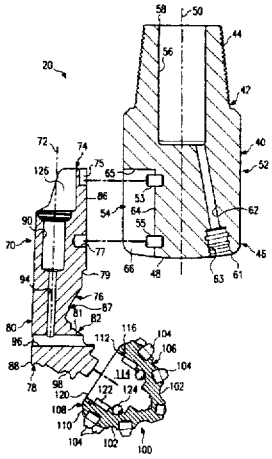

OTHER PUBLICATIONS

Brochure, Security DBS, *The New ERA in Drill Bit Performance Has Arrived,* undated.

U.S. Patent Application No. 08/287,441, filed Aug. 8, 1994 entitled *Rotary Cone Drill Bit with Improved Support Arms,* pending.

U.S. Patent Application No. 08/287,390 filed Aug. 8, 1994 entitled *Rotary Drill Bit and Method for Manufacture and Rebuild,* pending.

U.S. Design Patent Application No. 29/033,599 filed Jan. 17, 1995 entitled *Rotary Cone Drill Bit,* abandoned.

U.S. Design Patent Application No. 29/033,630 filed Jan. 17, 1995 entitled *Support Arm and Rotary Cone for Modular Drill Bit,* allowed.

U.S. Patent Application No. 08/351,019 filed Dec. 7, 1994 entitled *Rotary Cone Drill Bit and Method for Enhanced Lifting of Fluids and Cuttings,* abandoned.

U.S. Patent Application No. 08/350,910 filed Dec. 7, 1994 entitled *Rotary Cone Drill Bit with Angled Ramps,* allowed.

U.S. Patent Application No. 08,478,455 filed Jun. 9, 1995 entitled *Rotary Cone Drill Bit Modular Arm,* pending.

U.S. Patent Application No. 08/422,140 filed Apr. 13, 1995 entitled *Rotary Drill Bit and Method for Manufacture and Rebuild,* pending.

U.S. Design Patent Application No. 29/043,782 filed Sep. 12, 1995 entitled *Rotary Cone Drill Bit,* pending.

International Search Report dated Sep. 5, 1996 for pending International Application No. PCT/US96/08522.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 12 is cancelled.

Claims 1–3, 10, 11, and 14–16 are determined to be patentable as amended.

Claims 4–9, 13 and 17–20, dependent on an amended claim, are determined to be patentable.

1. A rotary cone drill bit for forming a borehole, comprising:

a one-piece bit body having an upper portion *formed as an integral part thereof and* adapted for connection to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equal to said number of support arms and mounted respectively on one of said spindles; [and]

said bit body having a lower portion with a generally convex exterior surface formed thereon to provide enhanced fluid flow between said cutter cone assemblies and said lower portion of said bit body*;*

*each support arm having a longitudinal axis extending therethrough with an upper end, an exterior surface with a shirttail surface formed as a part thereof and a bottom edge with said inside surface and said shirttail surface contiguous at said bottom edge;*

*each of said support arms having a first side and a second side extending from said inside surface;*

*the dimensions of said upper end and the adjacent portions of said inside surface and said first side and said second side selected to allow securing a portion of each of said support arms within a respective pocket formed in said bit body;*

*a spindle attached to said inside surface near said bottom edge and angled downwardly and inwardly with respect to each of said support arms;*

*each of said cutter cone assemblies having an opening with a chamber extending therefrom for mounting said respective cutter cone assembly on one of said spindles; and*

*means provided on said inside surface of each of said support arms for alignment and positioning of said respective support arm within one of said pockets during fabrication of said drill bit.*

2. The drill bit as defined in claim 1 wherein said one-piece bit body further comprises:

a middle portion disposed between said upper portion and said lower portion of said bit body;

said middle portion having a generally cylindrical configuration;

[a number of] *said* pockets formed in the exterior of said middle portion of said bit body for attaching said support arms to said bit body with said number of pockets [equalling] *equaling* said number of support arms; and said pockets spaced from each other on the exterior of said middle portion.

3. The drill bit as defined by claim 1 wherein said bit body further comprises:

a middle portion disposed between said upper portion and said lower portion of said bit body;

said middle portion having a generally cylindrical configuration;

[a number of] *said* pockets formed in the exterior of said middle portion of said bit body for attaching said support arms to said bit body with said number of pockets [equalling] *equaling* said number of support arms; and a number of cutouts formed in the exterior of said bit body intermediate said pockets.

10. [The drill bit as defined in claim 5 further comprising:] *A rotary cone drill bit for forming a borehole, comprising:*

*a one-piece bit body having an upper portion adapted for connection to a drill string for rotation of said drill bit;*

*a number of support arms attached to said bit body and extending opposite from said upper portion, each of said support arms having an inside surface with a spindle connected thereto, each spindle projecting generally downwardly and inwardly with respect to its associated support arm;*

*a number of cutter cone assemblies equal to said number of support arms and mounted respectively on one of said spindles;*

*said bit body having a lower portion with a generally convex exterior surface formed thereon to provide enhanced fluid flow between said cutter cone assemblies and said lower portion of said bit body;*

*said bit body having a longitudinal axis corresponding generally with the projected axis of rotation of said drill bit;*

*an enlarged cavity formed within said upper portion of said bit body;*

*an opening in said cavity for communicating fluids between said drill string and said cavity;*

*at least one fluid passageway formed in said bit body extending between said cavity and said lower portion of said bit body;*

*a nozzle disposed in said fluid passageway adjacent to said lower portion of said bit body;* a first fluid passageway formed in said bit body extending between said cavity and said lower portion of said bit body;

a second fluid passageway formed in said bit body extending between said first fluid passageway and said exterior of said middle portion of said bit body; and said second passageway formed at an angle with respect to said first fluid passageway whereby any fluid exiting from said second passageway will assist fluid flow in an annulus defined in part by said drill bit and the said borehole.

11. A rotary cone drill bit forming a borehole having a side wall and bottom comprising:

a one-piece bit body having an upper portion formed as an integral part thereof with a threaded roller bit connection formed on the exterior of said upper portion for connecting said drill bit to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equally said number of support arms with one of said cutter cone assemblies mounted respectively on each spindle for boring engagement with said side wall and bottom of said borehole;

said bit body having a lower portion with a generally convex exterior surface formed thereon to provide enhanced fluid flow between said cutter cone assemblies and said lower portion of said bit body;

a middle portion disposed between said upper portion and said lower portion of said bit body; [and]

said middle portion having a generally cylindrical configuration with [said support arms attached thereto] *a number of pockets formed in the exterior of said middle portion of said bit body and spaced from each other for use in attaching said support arms to said bit body with said number of pockets equalling said number of support arms;*

*each of said pockets having an upper surface formed as an integral part thereof for engagement with a top surface provided on its respective support arm;*

*each of said pockets having a back wall extending substantially parallel with said longitudinal axis of said bit body;*

*a pair of sidewalls extending at an acute angle relative to said back wall; and*

*the dimensions of said back wall and said sidewall selected to allow inserting a portion of said respective support arm partially therein.*

14. The [rotary cone] drill bit as defined by claim 11 further comprising:

said middle portion of said bit body having an outside diameter;

said upper portion of said bit body having an outside diameter compatible with said threaded roller bit connection formed thereon; and said outside diameter of said upper portion approximately equal to said outside diameter of said middle portion and said outside diameter approximately equal to the minimum API diameter required for said threaded roller bit connection.

15. The drill bit as defined by claim 11 further comprising[:

a number of pockets formed in the exterior of said middle portion of said bit body for use in attaching said support arms to said bit body with said number of pockets equal to said number of support arms; and]

each support arm having a longitudinal axis with approximately one third of the length of each support arm disposed in its [associated] *respective* pocket.

16. A rotary cone drill bit for forming a borehole having a side wall and bottom comprising:

a one-piece bit body having an upper portion with a threaded roller bit connection formed on the exterior of said upper portion for connecting said drill bit to a drill string for rotation of said drill bit;

a number of support arms attached to said bit body and extending opposite from said upper portion, each of said support arms having an inside surface with a spindle connected thereto, each spindle projecting generally downwardly and inwardly with respect to its associated support arm;

a number of cutter cone assemblies equal to said number of support arms with one of said cutter cone assemblies mounted respectively on each spindle for boring engagement with said side wall and bottom of said borehole;

said bit body having a lower portion with a generally convex exterior surface formed thereon to provide enhanced fluid flow between said cutter cone assemblies and said lower portion of said bit body;

a middle portion disposed between said upper portion and said lower portion of said bit body, said middle portion having a generally cylindrical configuration with an outside diameter based in part on the required dimensions for said threaded roller bit connection;

a number of pockets formed in the exterior of said middle portion of said bit body for attaching said support arms to said bit body with said number of pockets equalling said number of support arms[; and]

*each of said pockets having an upper surface formed as an integral part thereof for engagement with a top surface provided on its respective support arm; and* said pockets equally spaced around the perimeter of said middle portion.

* * * * *